US007993722B2

(12) United States Patent
Sturley

(10) Patent No.: US 7,993,722 B2
(45) Date of Patent: Aug. 9, 2011

(54) SUBSTRATE SUCH AS PAVING BRICK WITH NON-POWERED PHOTOLUMINESCENT PORTION

(75) Inventor: David K. Sturley, Royal Oak, MI (US)

(73) Assignee: Glow-Mark Technologies, LLC, Royal Oak, MI (US)

( * ) Notice: Subject to any disclaimer, the term of this patent is extended or adjusted under 35 U.S.C. 154(b) by 730 days.

(21) Appl. No.: 12/044,286

(22) Filed: Mar. 7, 2008

(65) Prior Publication Data

US 2008/0217584 A1 Sep. 11, 2008

Related U.S. Application Data

(60) Provisional application No. 60/893,808, filed on Mar. 8, 2007.

(51) Int. Cl.

| | |
|---|---|
| ***B44C 1/26*** | (2006.01) |
| ***B44C 1/28*** | (2006.01) |
| ***B44C 3/12*** | (2006.01) |
| ***B32B 5/16*** | (2006.01) |
| ***B32B 9/00*** | (2006.01) |
| ***B32B 19/00*** | (2006.01) |
| ***E02D 27/00*** | (2006.01) |
| ***E04H 13/00*** | (2006.01) |
| ***F21K 2/00*** | (2006.01) |

(52) U.S. Cl. ..... 428/67; 428/141; 428/143; 428/323; 428/328; 428/330; 428/690; 52/102; 52/103; 250/462.1; 250/483.1

(58) Field of Classification Search ..... 40/542, 40/543, 544; 428/67, 141, 143, 161, 323, 428/328, 329, 330, 690, 913, 917; 250/462.1, 250/483.1; 52/102, 103, 104, 105
See application file for complete search history.

(56) References Cited

U.S. PATENT DOCUMENTS

| | | | | |
|---|---|---|---|---|
| 4,998,391 | A * | 3/1991 | Connew | 52/179 |
| 5,315,491 | A | 5/1994 | Spencer et al. | |
| 5,904,017 | A * | 5/1999 | Glatz et al. | 52/287.1 |
| 6,375,864 | B1 | 4/2002 | Phillips et al. | |
| 6,665,986 | B1 | 12/2003 | Kaplan | |
| 6,696,126 | B1 * | 2/2004 | Fischer et al. | 428/40.2 |
| 6,828,043 | B2 | 12/2004 | Sturley | |
| 2004/0137266 | A1 * | 7/2004 | Saito et al. | 428/690 |
| 2005/0102871 | A1 | 5/2005 | Merle et al. | |
| 2005/0160637 | A1 | 7/2005 | Hesse | |
| 2006/0291197 | A1 | 12/2006 | Patti | |
| 2007/0209747 | A1 | 9/2007 | Merle et al. | |

FOREIGN PATENT DOCUMENTS

WO WO 01/42386 A2 6/2001

* cited by examiner

*Primary Examiner* — David R Sample
*Assistant Examiner* — Catherine Simone

(57) ABSTRACT

A non-powered photoluminescent paving brick includes a substrate defining one of a cavity and a channel that extends from one end to an opposite end of the substrate. A photoluminescent portion includes a light transmissive resin including a suspension of photoluminescent particles. The photoluminescent portion is arranged in the one of the cavity and the channel and wherein the light transmissive resin has an exposed outer surface that directly receives light.

20 Claims, 10 Drawing Sheets

SUBSTRATE SUCH AS PAVING BRICK WITH NON-POWERED PHOTOLUMINESCENT PORTION

CROSS-REFERENCE TO RELATED APPLICATIONS

This application claims the benefit of U.S. Provisional Application No. 60/893,808, filed on Mar. 8, 2007, which is incorporated herein by reference in its entirety.

FIELD

The present disclosure relates to substrates such as paving bricks, tile and the like having a cavity or channel with a photoluminescent portion arranged therein.

BACKGROUND

The statements in this section merely provide background information related to the present disclosure and may not constitute prior art.

Referring now to FIGS. 1 and 2, a non-powered photoluminescent paving brick 10 includes a paving brick base 14 that defines a cavity 16. A photoluminescent laminate structure 20 is attached in the cavity 16. The photoluminescent laminate structure is made before attachment in cavity 16. Glue, resin or other adhesive material and/or mechanical fasteners may be used to attach the photoluminescent laminate structure 20 in the cavity 16 of the paving brick base 14. For example, the photoluminescent paving brick 10 can be installed in a walkway to provide light during low light conditions. During daylight hours, the photoluminescent laminate structure 20 absorbs light energy. When the light is removed at dusk, the photoluminescent laminate structure 20 emits light or glows, which provides a non-powered source of light.

In FIG. 2, the photoluminescent laminate structure 20 may include first and second transparent layers 24 and 28 that sandwich an inner photoluminescent layer 26. The transparent layers 24 and 28 typically comprise glass or plastic. The inner layer 26 may comprise a resin layer with photoluminescent or phosphorescent particles suspended therein. The resin that is used typically cures in the absence of air since the resin layer is located between the transparent layers 24 and 28. The resin is typically solvent-based and experiences shrinkage as the solvent is released as a gas. The resin also typically has a relatively high viscosity and low compressive and tensile strength.

One problem associated with the approach shown in FIGS. 1 and 2 includes relatively high material cost for the glass or plastic layers 24 and 28. In addition, the manufacturing cost of the non-powered photoluminescent paving brick is also relatively high. In particular, creating a uniform layer of resin between the transparent layers 24 and 28 can be difficult.

In addition, the durability of the non-powered photoluminescent paving brick 10 may be suspect. There is a tendency for damage to occur when water seeps into gaps between the paving brick base 14 and the photoluminescent laminate structure 20. Since the paving brick 10 is typically installed outdoors, the paving brick 10 is subject to wide temperature variation and standing water. When the water freezes and thaws, it expands and contracts and the laminate structure 20 experiences relatively high pressure. In addition, the photoluminescent laminate structure 20 may experience delamination when soaked in water—even in the absence of freezing temperatures. As a result, the photoluminescent laminate structure 20 may tend to delaminate, break or separate from the paving brick base 14.

Furthermore, when an outer surface of the transparent layer 28 of the photoluminescent laminate structure 20 becomes wet, a coefficient of friction of the outer surface may be reduced. Since the paving brick 10 may often provide a walking surface, the non-powered photoluminescent paving brick 10 may be relatively slippery.

SUMMARY

A non-powered photoluminescent paving brick includes a substrate defining one of a cavity and a channel that extends from one end to an opposite end of the substrate. A photoluminescent portion includes a light transmissive resin including a suspension of photoluminescent particles. The photoluminescent portion is arranged in the one of the cavity and the channel and wherein the light transmissive resin has an exposed outer surface that directly receives light.

In other features, friction-enhancing particles are suspended in the photoluminescent portion. The photoluminescent portion has a first thickness, wherein the friction-enhancing particles have a cross-sectional dimension that is greater than the first thickness and wherein at least part of the friction-enhancing particles project outwardly from an outer surface of the photoluminescent portion. The photoluminescent portion comprises a plurality of stacked resin layers and wherein the friction-enhancing particles are suspended in one of the plurality of stacked resin layers.

In other features, the photoluminescent portion has a thickness that is greater than about 1/16" and less than about 1/2". The photoluminescent particles have a size between 2 and 200 microns. The light transmissive resin has a shrinkage factor that is less than 0.1%. The light transmissive resin is substantially solvent-free. The light transmissive resin has tensile and compressive strengths that are greater than about 1000 psi. The photoluminescent particles absorb ultraviolet light and re-emit visible light.

In other features, a reflective layer is arranged between an inner surface of the photoluminescent portion and the cavity, wherein the reflective layer comprises resin and at least one of pigment and reflective particles suspended therein. The channel has one of a rectangular, square or trapezoidal cross section perpendicular to a direction of the channel. The photoluminescent portion and the reflective layer have a combined thickness that is greater than or equal to about 1/16" and less than or equal to about 1/2". The photoluminescent portion and the reflective layer each have a thickness of about 1/8". The resin in the reflective layer and the photoluminescent portion forms a substantially seamless bond during curing.

A non-powered photoluminescent paving brick comprises a substrate for the non-powered photoluminescent paving brick that includes plastic. A photoluminescent portion comprising a light transmissive resin including a suspension of photoluminescent particles formed on one surface of the substrate.

In other features, anchoring cavities are formed in the substrate, wherein the photoluminescent portion is received in the anchoring cavities. Friction-enhancing particles suspended in the photoluminescent portion. The photoluminescent portion has a first thickness, wherein the friction-enhancing particles have a cross-sectional dimension that is greater than the first thickness and wherein at least part of the friction-enhancing particles project outwardly from an outer surface of the photoluminescent portion. The light transmissive resin has a viscosity that is less than 1000 centipoise.

In other features, the photoluminescent portion has a thickness that is greater than about 1/16" and less than about 1/2". The photoluminescent particles have a size between 2 and 200 microns. The light transmissive resin has a shrinkage factor that is less than 0.1%. The light transmissive resin is substantially solvent-free. The light transmissive resin has tensile and compressive strengths that are greater than about 1000 psi.

In other features, anchoring cavities are formed in the substrate. The photoluminescent portion includes a first layer of the light transmissive resin that forms anchoring portions that extend from one side of the first layer into the cavities, wherein an opposite side of the first layer is substantially planar. A second layer is formed on the opposite side of the first layer and comprising the light transmissive resin and the suspension of photoluminescent particles.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. Unless otherwise stated herein, it is understood that features described with respect to one embodiment or FIG. may be used in any other FIG. or embodiment described herein.

Figure 1:
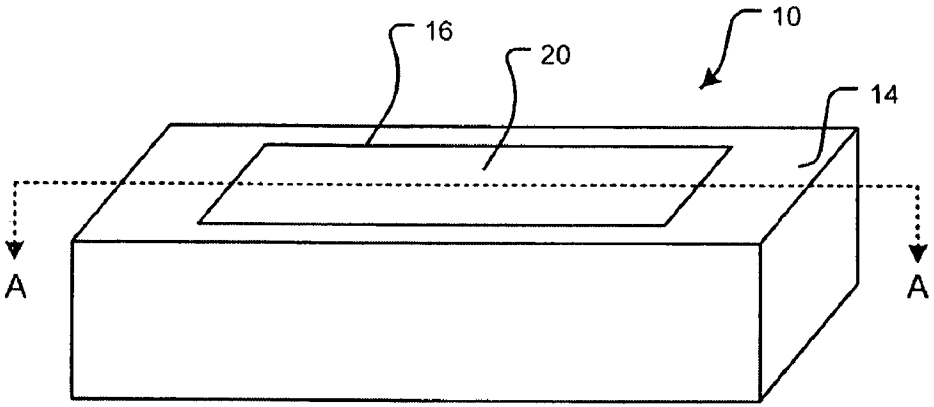
FIG. 1 Prior Art
FIG. 1 is a perspective view of a non-powered photoluminescent paving brick according to the prior art.
Figure 2:
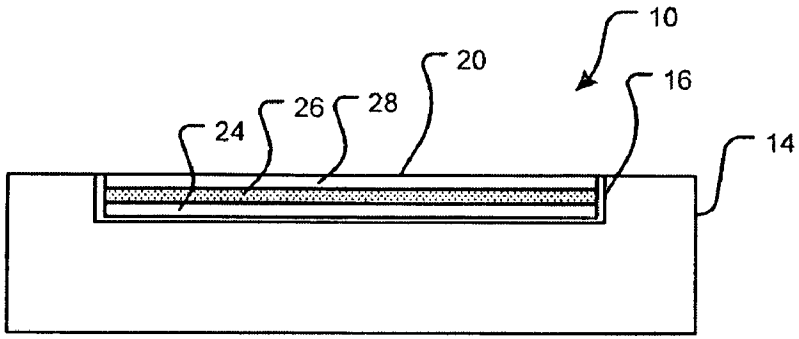
FIG. 2 Prior Art
FIG. 2 is a cross-sectional view of the photoluminescent paving brick of FIG. 1.
Figure 3B:
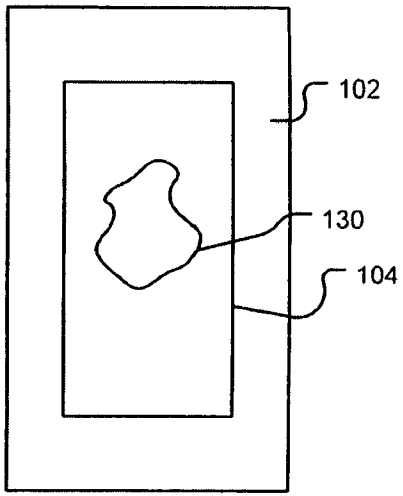
FIG. 3B is a plan view illustrating a first cavity and an optional second cavity.
Figure 3A:
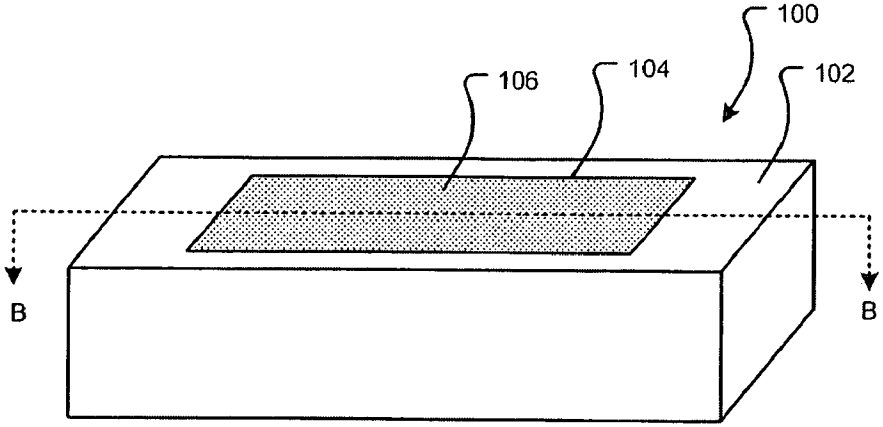
FIG. 3A is a perspective view of a non-powered photoluminescent device according to the present disclosure.
Figure 4:
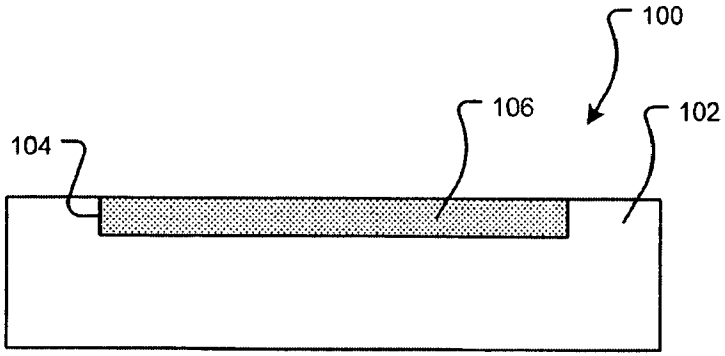
FIG. 4 is a cross-sectional view of the photoluminescent device of FIG. 3A.

Referring now to FIGS. 3A, 3B and 4, a non-powered photoluminescent device 100 according to the present disclosure is shown. While the present disclosure will describe exemplary paving bricks, the techniques described herein may be applied to any suitable substrate with a cavity or channel. For example, the substrate may include cement, asphalt, tile, other floor materials, decorative molding or other substrates.

The non-powered photoluminescent device 100 includes a paving brick or other substrate 102 defining a cavity 104. The cavity 104 may be formed during manufacturing or cut after manufacturing. While a rectangular cavity is shown, the cavity 104 may have any suitable shape. The cavity 104 may have a shape in the form of letters, logos, or other suitable shapes. Two or more adjacent paving bricks may have different-shaped cavities that together form a shape. For example only, multiple paving bricks may show a direction of a walking path.

A photoluminescent resin layer 106 may be cast, molded or formed in the cavity 104. Alternatively, the photoluminescent resin layer 106 may be cast, molded or formed and then later installed in the cavity 104. The same resin may be used to adhere the layer 106 in the cavity 104. The photoluminescent resin layer 106 includes a transparent resin material with photoluminescent or phosphorescent particles suspended therein, as will be described further below.

In FIG. 3B, the cavity 104 may optionally include a second cavity 130 having a regular or irregular shape. The second cavity 130 may be smaller than the cavity 104. The second cavity 130 is shown with an irregular shape. Examples of regular shapes include squares, circles, polygons, and/or other symmetric shapes. The second cavity 130 provides additional surface area to which the resin may attach inside the cavities 104 and 130. As a result, durability may be improved. The second cavity 130 may also be used as a watermark to differentiate genuine paving bricks from knock-off paving bricks.

In some implementations, the resin may include a two-part resin. The resin may be a solvent-free resin that experiences negligible shrinkage during curing. The resin may experience negligible evaporation during curing. The resin may experience less than 0.1% shrinkage. More particularly, the resin may experience less than 0.01% shrinkage. For example only, the resin may be Crystal Clear™ resin available from Smooth-On located in Pennsylvania, United States. Crystal Clear™ 202 resin may be used, although other resins are contemplated.

The resin may have a high tensile strength after curing. The resin may have tensile and compressive strengths greater than about 1000 psi. The resin may have a tensile and compressive strength greater than 2000 psi. Crystal Clear™ 202 has a tensile strength of 2800 psi, a compressive strength of 2208 psi and a shrinkage factor or approximately 0.0013 inches per inch. The resin may be clear and UV resistant.

The resin may have a relatively low viscosity to allow the resin to seep into pores of the paving brick or substrate to ensure that the photoluminescent resin layer 106 attaches securely to a surface of the cavity 104. In other words, high viscosity material may not seep into the pores of the substrate and adequately bond therewith, which may result in delamination. For example, Crystal Clear™ 202 has a viscosity of approximately 600 centipoise (cps) at 72° F. The resin may have a viscosity that is less than 1500 cps at 72° F. The resin may have a viscosity that is less than 1000 cps at 72° F. The resin may have a viscosity that is about 600 cps at 72° F. plus or minus 100 cps.

When multiple layers of the resin are used and fully or partially cured, the resin may form relatively seamless bonds between the layers. In other words, the multiple layers bond together and form a relatively seamless unitary structure that does not have compromised strength. Furthermore, the resin does not experience delamination of the multiple layers after curing. The bonds may also be optically clear after curing.

In some implementations, the photoluminescent resin layer 106 may have a thickness between ⅛" and ½", although other thicknesses may be used. In some implementations, the resin layer 106 may include between 3 grams (g) and 200 g of photoluminescent particles per ⅛" resin layer per 10 $in^2$. In some implementations, the resin layer 206 may include between 5-100 g of photoluminescent particles per ⅛" layer per 10 $in^2$. Other ranges such as 5-30 g or 5-15 g may be used. The photoluminescent particles may have a size between 2 and 200 microns. More particularly, the photoluminescent particles may have a size of about 70 microns. Other photoluminescent particles may a size of 200 microns.

Suitable photoluminescent particles include long decay phosphors described in U.S. Pat. No. 5,376,303, long afterglow phosphors of U.S. Pat. No. 5,885,483 and photostorage and emissive materials of U.S. Pat. No. 6,177,029, which are all hereby incorporated by reference in their entirety.

The long decay phosphor of U.S. Pat. No. 5,376,303 is comprised of $MO.a(A1_{1-b}B_b)_2O_3:cR$ herein:

$0.5 \leqq a \leqq 10.0$, $0.0001 \leqq b \leqq 0.5$ and $0.0001 \leqq c \leqq 0.2$, MO represents at least one divalent metal oxide selected from the group consisting of MgO, CaO, SrO and ZnO and R represents Eu and at least one additional rare earth element selected from the group consisting of Pt, Nd, Dy and Tm.

In U.S. Pat. No. 5,885,483, the long afterglow phosphors comprise a sinter expressed by a general formula $MO.(n-x)\{a\ A1_2O_3a*(1-a)A1_2O_3^{\gamma}\}B_2O_3:R$ wherein M represents an alkaline earth metal, T represents a rare earth element, $0.5<a \leqq 0.99$, $0.001 \leqq x \leqq 0.35$, $1 \leqq n \leqq 8$ and a part of M may be replaced with at least one alkaline earth metal selected from the group consisting of Mg, Ca and Ba.

The photostorage and emissive material of U.S. Pat. No. 6,177,029 is composed of photoluminescent material that absorbs light from a light source such as UV light. The photoluminescent material re-emits the light energy in a first wavelength spectrum when the light source is removed. A second material is mixed with the photoluminescent material. The second material is selected from the group consisting of fluorescent colorants and optical brighteners that absorb light at the first wavelength spectrum and re-emit the absorbed light at a second wavelength spectrum. The phosphorescent particles described herein may absorb light at ultraviolet wavelengths and re-emit light at visible wavelengths.

In use, the non-powered photoluminescent device 100 absorbs ultraviolet light energy into the photoluminescent particles, which store the energy until a source of light is removed. For outdoor applications, the source of light may be removed when the sun goes down. For other applications, the source of light may be removed when a powered source of light is turned off (for example intentionally, due to power failure or other emergency). When the source of light is removed, the particles emit light energy in the visible spectrum.

The photoluminescent particles can be the photoluminescent particles described above and in the concentrations described above (hereinafter high light (HL) photoluminescent particles). The photoluminescent particles are called HL due to their ability to be charged outdoors by UV light with only ordinary degradation of the photoluminescent particles. The photoluminescent particles may be charged on cloudy days since UV light will be present—unlike some solar powered devices.

In other embodiments, low light (LL) photoluminescent particles are used alone or in combination with the HL photoluminescent particles. The LL photoluminescent particles have a shorter charge time and require lower levels of UV light to charge. The LL photoluminescent particles charge with indoor sources of light but experience accelerated degradation if charged with higher intensity outdoor light. The LL photoluminescent particles may be suitable for indoor applications.

The LL photoluminescent particles may include GLL300M available under the trademark Luminova® from United Mineral and Chemical Corp. of Lyndhurst, N.J. and Nemota & Co. LTD. of Tokyo, Japan. The HL photoluminescent particles may include G300, BG300 or V300 available under the trademark Luminova® from United Mineral and Chemical Corp. and Nemota & Co. LTD. of Tokyo, Japan. As can be appreciated, the photoluminescent resin layers described above can also be implemented using LL, HL and/or LL and HL photoluminescent particles. LL photoluminescent particles may be suitable for indoor applications such as indoor pavers, tile, molding, trim, swimming pool steps, risers and the like.

Figure 5A:
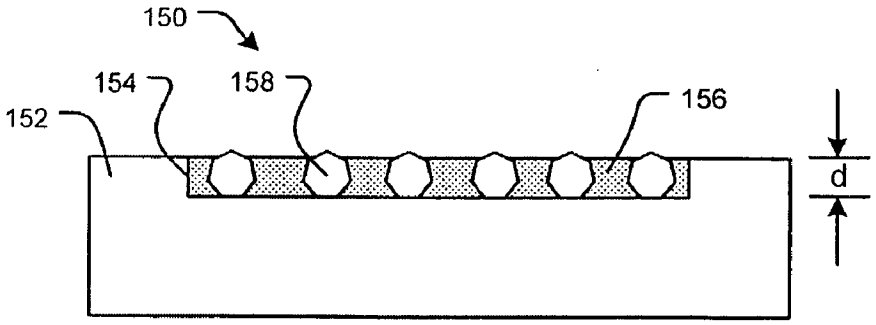
FIGS. 5A and 5B are cross-sectional views illustrating friction-enhancing particles suspended in a resin layer.
Figure 5B:
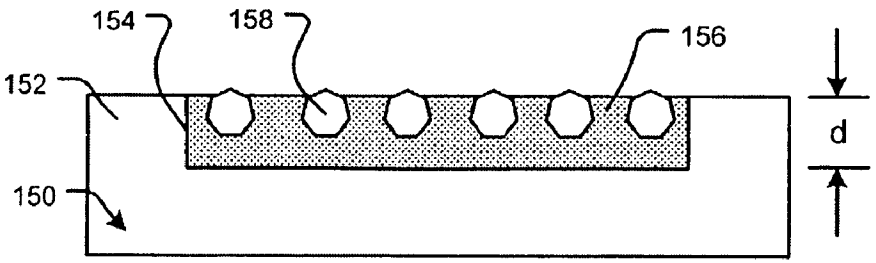

Referring now to FIGS. 5A and 5B, friction-enhancing particles can be added to the resin layer that includes the photoluminescent particles. In FIG. 5A, a photoluminescent device 150 includes a cavity 154 and a photoluminescent resin layer 156. Friction-enhancing particles 158 may be added to the photoluminescent resin layer 156.

The friction-enhancing particles 158 may have an outer dimension that is greater than a thickness "d" of the photoluminescent layer 156 such that at least part of the frictional particles project outwardly from an outer surface of the photoluminescent layer 156. The thickness "d" may be greater than or equal to 1/16" and less than or equal to ½". The thickness "d" may be about ⅛". Still other thicknesses are contemplated.

The friction-enhancing particles 158 may be transparent or clear to allow light to pass through. In some implementations, the friction-enhancing particles 158 may include Aluminum Oxide ($AlO_2$) particles, Silica particles, and/or Quartz particles, although other materials may be used. The friction-enhancing particles 158 may be mixed with the resin and the photoluminescent particles and then poured into the cavity 154. Alternately the friction-enhancing particles may be added to a mixture of the resin and photoluminescent particles after the mixture has been poured into the cavity 154. The friction-enhancing particles may have any suitable shape.

In FIG. 5B, the friction-enhancing particles 158 have an outer dimension that is less than a thickness "d" of the photoluminescent layer 156. There are several ways to implement the embodiment in FIG. 5B. For example only, the photoluminescent particles 158 can be added after the resin in the photoluminescent portion has been poured into the cavity and has at least partially cured. The increased viscosity due to partial curing may allow the friction-enhancing particles to float above the outer surface while being part of the resin layer. Alternately, the friction-enhancing particles can be selected to have a density that is less than the density of the resin in the photoluminescent layer 156. These lower-density friction-enhancing particles can be added to the mixture before or after pouring. Since the density is lower, they will tend to float at least partially above the outer surface. Still other variations are contemplated. The friction-enhancing particles may be glued to an outer surface after the outer layer has cured.

Figure 6:
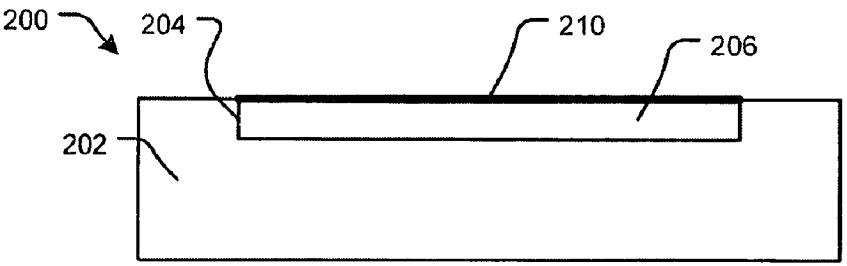
FIG. 6 is a cross-sectional view illustrating an outer surface having a higher coefficient of friction due to sanding or another abrasive method.

Referring now to FIG. 6, a photoluminescent device 200 includes a cavity 204 formed in a paving brick or other substrate 202 and a photoluminescent resin layer 206 in the cavity 204. An abrasive material such as sanding paper or a grinding wheel may be used to scuff an outer surface 210 of the photoluminescent layer 206 to increase a coefficient of friction of the outer surface 210. The photoluminescent resin layer 206 may have a thickness greater than or equal to 1/16" and less than or equal to ½". The photoluminescent resin layer 206 may have a thickness of approximately ⅛". Still other thicknesses are contemplated.

Figure 7B:
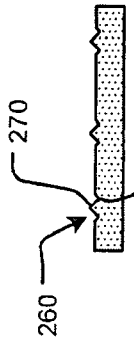
FIG. 7B is a cross-sectional view the embossed or grooved outer surface of the resin layer of FIG. 7A.
Figure 7A:
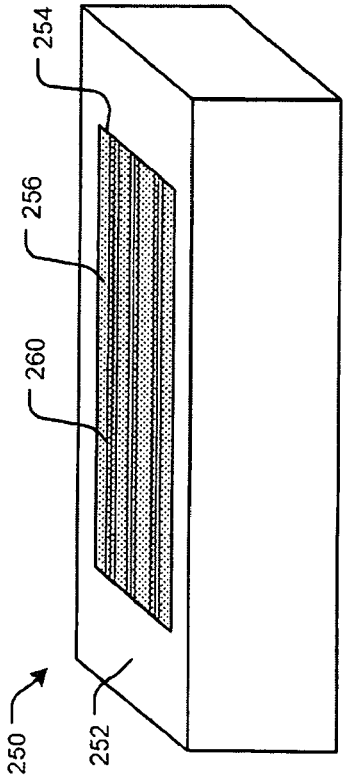
FIG. 7A is a perspective view of an alternate photoluminescent device with an embossed or grooved outward facing surface.

Referring now to FIGS. 7A and 7B, an alternate photoluminescent device 250 with an embossed or grooved outer surface is shown. In FIG. 7A, a photoluminescent device 250 includes a cavity 254 formed in a paving brick or other substrate 252 and a photoluminescent resin layer 256 in the cavity 254. After the photoluminescent portion is at least partially cured, an outer surface thereof is scored or embossed at 260 to create raised portions 270 and/or lowered portions 272 as can be seen in FIG. 7B. The raised and/or lowered portions 270 and 272, respectively, tend to increase a coefficient of friction of the outer surface. The photoluminescent resin layer 256 may have a thickness greater than or equal to 1/16" and less than or equal to ½". The photoluminescent resin layer 256 may have a thickness of approximately ⅛". Still other thicknesses are contemplated.

Figure 8:
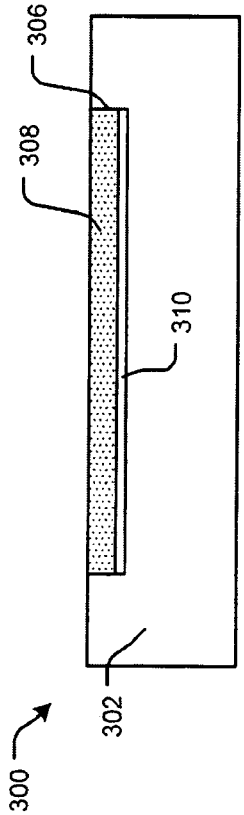
FIG. 8 is a side cross-sectional view of a reflective layer and a resin layer with suspended photoluminescent particles.

Referring now to FIG. 8, a photoluminescent device 300 includes a cavity 304. A photoluminescent resin layer 306 is arranged over a reflective layer 310 in the cavity 304. The reflective layer 310 may comprise any material that increases reflectivity of light incident thereon. The reflective layer 310 may include a paint layer applied to a surface of the paving brick. Alternately, the reflective layer 310 may include a layer of resin mixed with a light pigment such as a white, silver or other light colored pigment. Alternately, the reflective layer 310 may include a zinc metallic powder that is mixed with a resin layer. Other reflective layers may include a light colored fabric that is resin-permeable so that the resin may seep through the fabric and attach itself along a bottom surface of the cavity.

If the layer of resin mixed with pigment or zinc metallic powder is used, the layer may have a thickness greater than or equal to 1/16" and less than or equal to ½". The layer of resin may have a thickness of approximately ⅛". The photoluminescent resin layer 306 may have a thickness greater than or equal to 1/16" and less than or equal to ½". The photoluminescent resin layer 306 may have a thickness of approximately ⅛". Still other thicknesses are contemplated.

Figure 9:
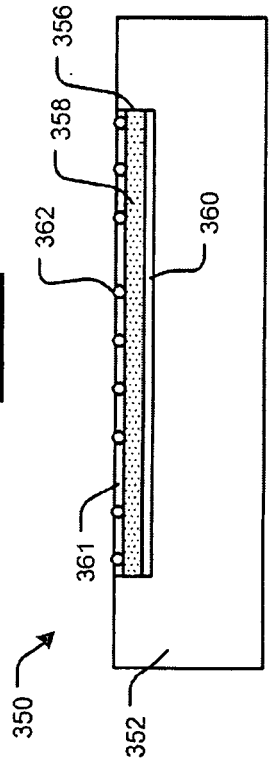
FIG. 9 is a side cross-sectional view of a reflective layer, a resin layer with suspended photoluminescent particles and a layer with friction-enhancing particles.

Referring now to FIG. 9, a photoluminescent device 350 includes a cavity 354 formed in a paving brick or other substrate 352. A reflective layer 360 is arranged in the cavity 354. A photoluminescent layer 358 is arranged above the reflective layer 360. A resin layer 361 is added and includes friction-enhancing particles 362. The friction-enhancing particles 362 may have an outer dimension that is greater than a thickness of the outer resin layer 361. As a result, at least part of the friction-enhancing particles project outwardly from an outer surface of the photoluminescent layer 361. Alternately, the friction-enhancing particles may be implemented as shown in FIG. 5B.

The reflective layer 360, the photoluminescent layer 358 and the resin layer 361 may have a combined thickness greater than 3/16" and less than ½". The lower reflective layer 360, the middle photoluminescent layer 358 and the outer resin layer 361 may each have a thickness of approximately ⅛". Still other thicknesses are contemplated.

Referring now to FIG. 10-14, various exemplary methods for making the photoluminescent device according to the present disclosure are shown.

Figure 10:
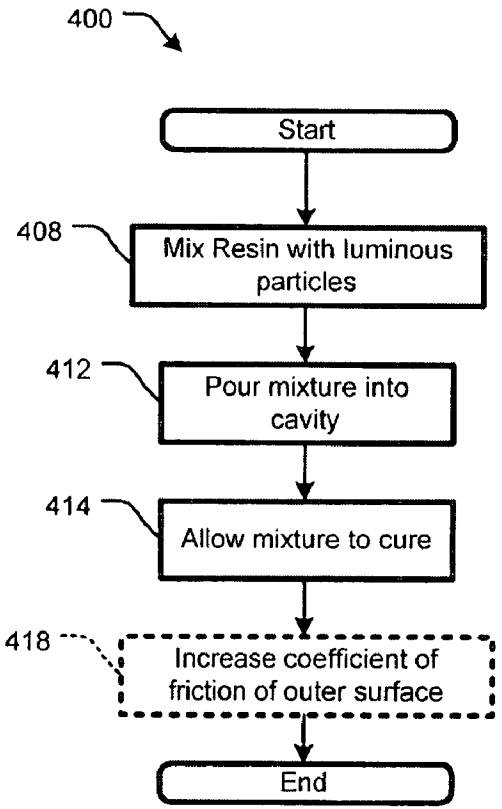

In FIG. 10, a first method 400 for making a non-powered photoluminescent substrate is shown. In step 408, resin is mixed with photoluminescent particles. In step 412, the mixture is poured into a cavity in a substrate. In step 414, the mixture is allowed to cure. In step 418, a coefficient of friction of an outer surface of the photoluminescent portion may be optionally increased using any of the methods described above.

Figure 11:
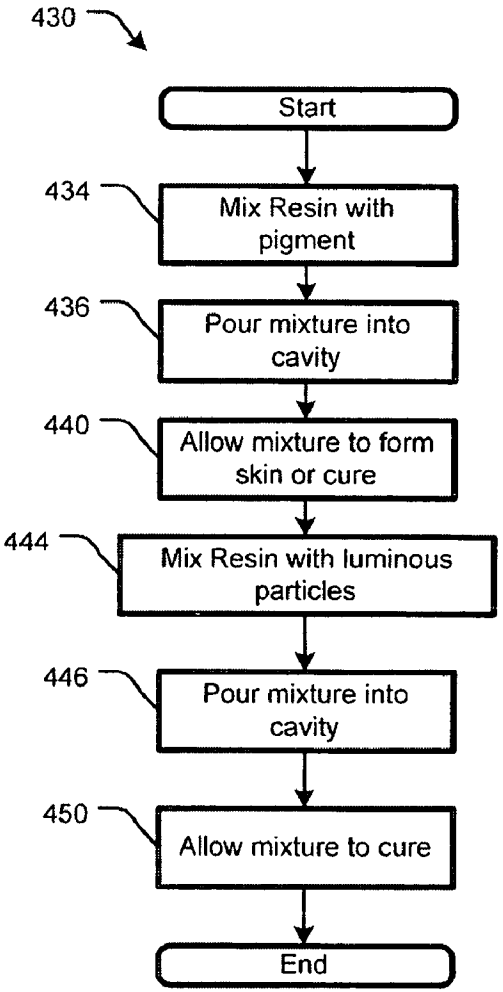
FIGS. 10-14 illustrate various exemplary methods for making the non-powered photoluminescent paving brick according to the present disclosure.

In FIG. 11, another method 430 for making a non-powered photoluminescent substrate is shown. In step 434, resin is mixed with pigment or zinc metallic powder. In step 436, the mixture is poured into a cavity in a substrate. In step 440, the mixture is allowed to cure or an outer skin is formed. An outer skin forms before curing occurs. In step 444, resin is mixed with photoluminescent particles. In step 446, the mixture is poured into the cavity. In step 450, the mixture is allowed to cure.

Figure 12:
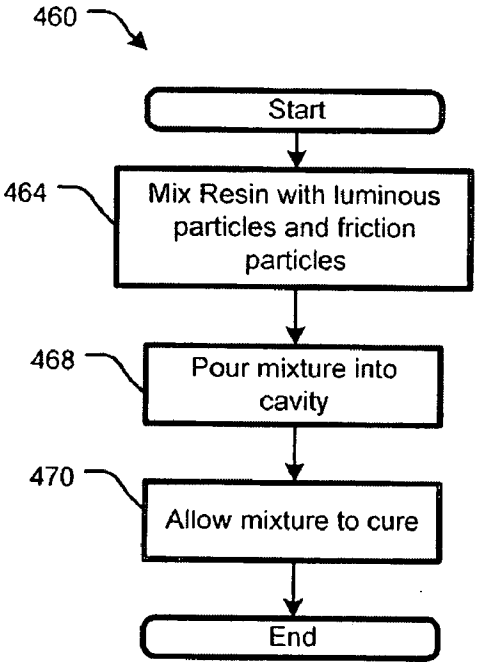

In FIG. 12, another method 460 for making a non-powered photoluminescent substrate is shown. In step 464, resin is mixed with photoluminescent particles and friction-enhancing particles. In step 468, the mixture is poured into a cavity. In step 470, the mixture is allowed to cure.

Figure 13:
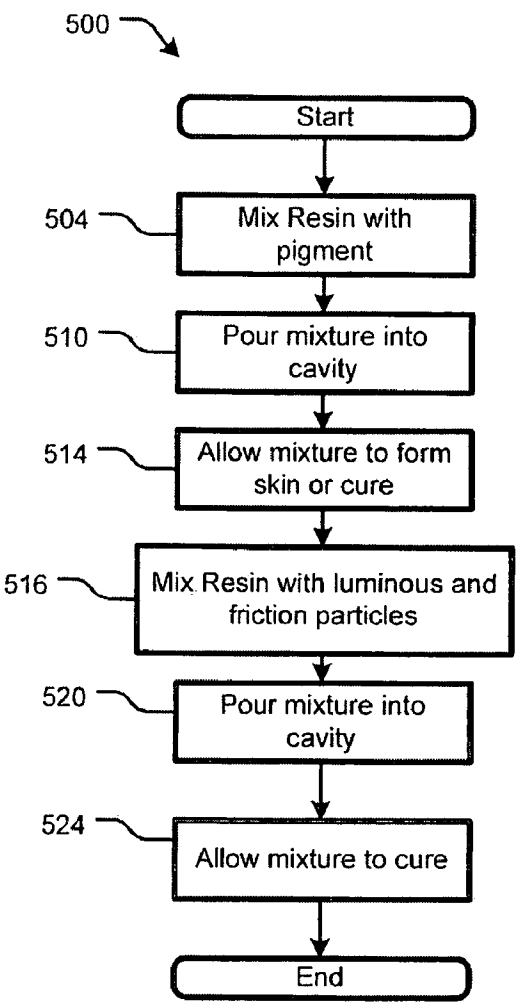

In FIG. 13, another method 500 for making a non-powered photoluminescent substrate is shown. In step 504, resin is mixed with a pigment. The mixture is poured into a cavity of a substrate in step 510. In step 514, the mixture is allowed to cure or form a skin. In step 516, the resin is mixed with photoluminescent particles and friction-enhancing particles. In step 520, the mixture is poured into the cavity of the substrate. In step 524, the mixture is allowed to cure.

Figure 14:
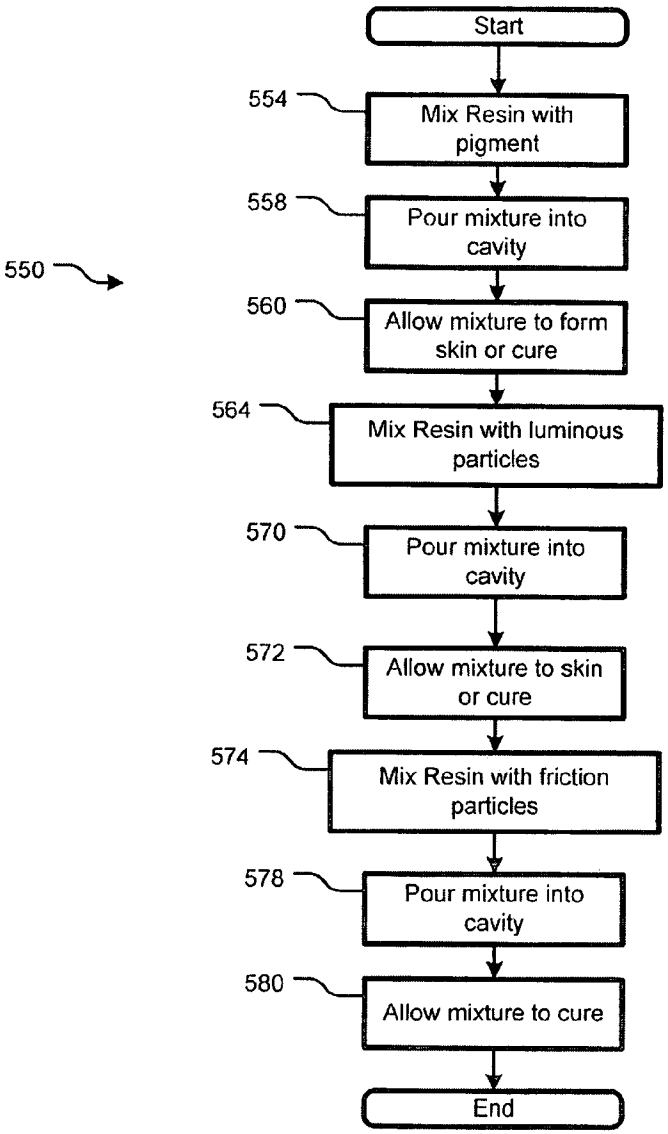

In FIG. 14, another method 550 for making a non-powered photoluminescent substrate is shown. In step 554, resin is mixed with pigment or zinc metallic powder as described above. In step 558, the mixture is poured into a cavity of a substrate. In step 560, the mixture is allowed to cure or form a skin. In step 564, the resin is mixed with photoluminescent particles. In step 570, the mixture is poured into the cavity of the substrate. In step 572, the mixture is allowed to cure and/or form a skin. In step 574, the resin is mixed with friction-enhancing particles. In step 578, the mixture is poured into a cavity. In step 580, the mixture allowed to cure.

In any of the foregoing embodiments, curing may be performed by allowing air drying. Alternately, curing may be accelerated using heat. In addition, cure enhancing additives may be added to the resin mixture.

Advantages of the foregoing include reduced manufacturing cost as compared to other approaches. In addition, the structure is more durable and resistant to the adverse effects of weather. Furthermore, the transparent layers are eliminated. These structures may reduce light incident upon the photoluminescent particles and may also reduce the intensity of the glow.

While the photoluminescent portion can be cast, molded or formed in the cavity or channel, the photoluminescent portion can be formed, cast or molded outside of the cavity or channel and then installed in the cavity or channel using an adhesive. For example only, the resin used for the photoluminescent portion can be used as an adhesive to attach the photoluminescent portion in the cavity or channel and to create a seamless bond.

Figure 15:
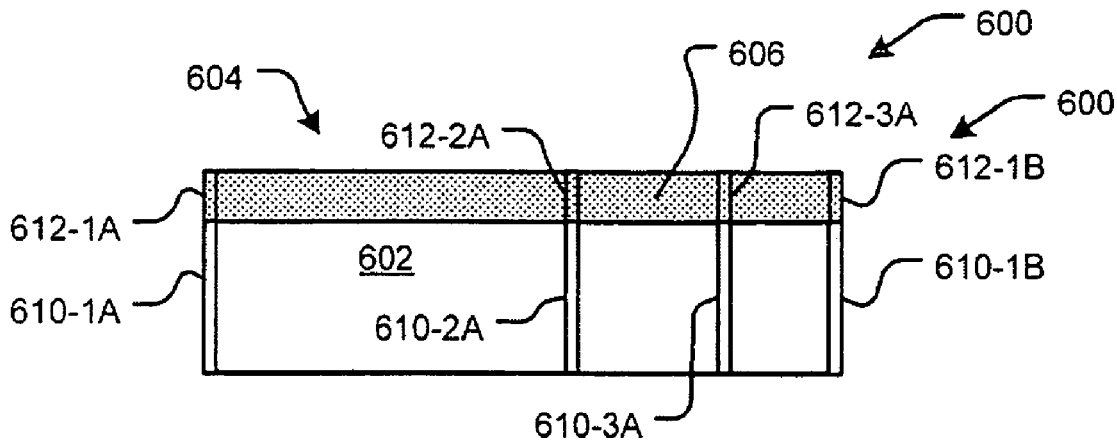
FIG. 15 illustrates another exemplary photoluminescent device.
Figure 16:
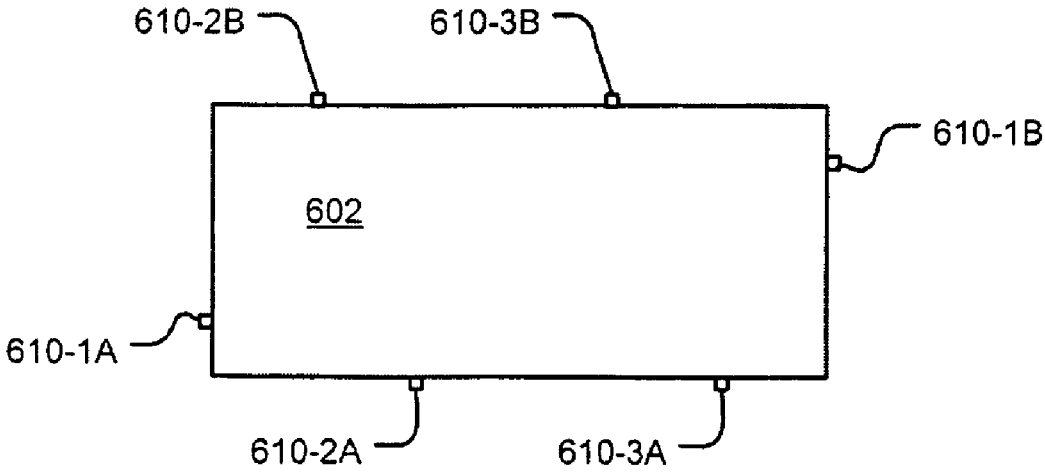
FIG. 16 illustrates a substrate of FIG. 15 in further detail.

Referring now to FIGS. 15 and 16, another exemplary photoluminescent paving brick or other device 600 comprises a substrate 602 and a photoluminescent portion 604. The substrate 602 can be made of high strength plastic that can be molded, cast or injected. The photoluminescent portion 604 may be formed as described above and may include any of the features described above. The plastic may include a material selected from a group consisting of Polypropylene, Nylon, Nylon 6, Nylon 6-6, Polybutylene Terepthalate (PBT) Polyester, Acrylic or other high tensile strength plastic. The plastic may have a high tensile strength sufficient to allow sidewalk or driveway traffic. The plastic may have a tensile strength greater than or equal to approximately 2000-3000 psi for light traffic. For heavy traffic, the plastic may have a tensile strength greater than approximately 7000-8000 psi. For pressures, the term approximately shall mean +/−500 psi. As can be appreciated, the lighter weight of the plastic substrate brick will make the bricks easier to ship.

The substrate 602 may have a generally rectangular shape, a circular shape, a square shape, a symmetric shape, a polygon shape and/or any other suitable shape. Raised portions 610-1A, 610-1B, 610-2A, 610-2B, 610-3A, and 610-3B (collectively raised portions 610) may be formed along sides of the substrate 602. Corresponding raised portions 612-1A, 612-1B, 612-2A, 612-2B, 612-3A, and 612-3B (collectively raised portions 612) may be formed along sides of the photoluminescent portion 604.

The raised portions 610 may align with corresponding ones of the raised portions 612. The raised portions 610 and 612 are offset such that they do not abut corresponding raised portions 610 and 612 on an adjacent paving brick when installed. As a result, sand, dirt or other filler material may be easily inserted between the abutting paver bricks to limit movement of the paver bricks.

Figure 17:
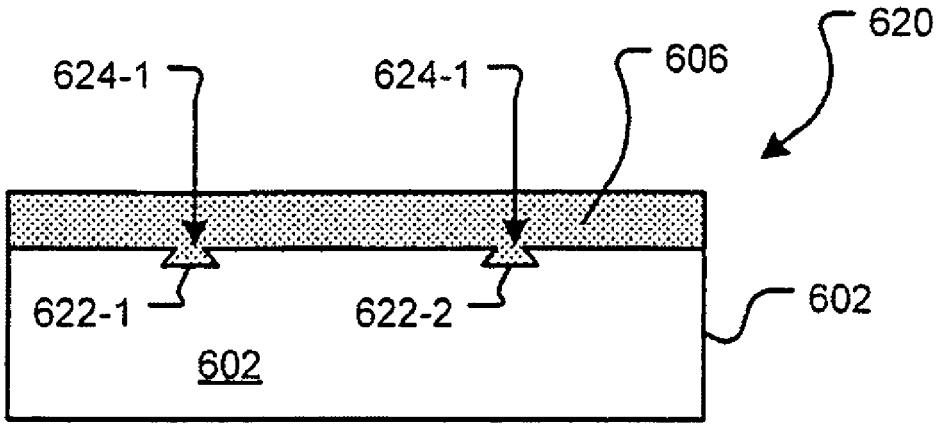
FIG. 17 illustrates an alternative substrate with anchoring cavities.

Referring now to FIG. 17, an alternative substrate with anchoring portions between the photoluminescent portion and the substrate is shown. The substrate 602 defines one or more anchoring cavities 622 (anchoring cavities 622-1 and 622-2 are shown) that allow part of the photoluminescent portion 604 to enter during manufacturing (casting or molding).

When the material dries, the photoluminescent portion 604 is securely held to the substrate 602. This structure greatly enhances strength—which may be helpful when the paving brick is subjected to changing temperatures and moisture. For example, the part of the photoluminescent portion 604 that enters the anchoring cavities 622 may include the resin alone, a mixture of the resin and photoluminescent particles (and/or other materials). As a result, the photoluminescent portion 604 forms one or more anchoring portions 624 (anchoring portions 624-1 and 624-2 are shown) that are secured in the anchoring cavities 622-1 and 622-2.

Figure 18:
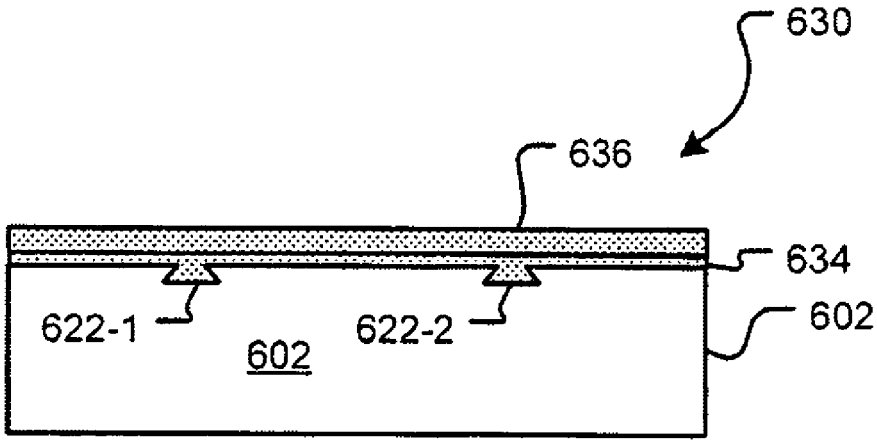
FIG. 18 illustrates a multi-layer photoluminescent portion.

Referring now to FIG. 18, two or more layers can be used to form the photoluminescent portion 604. A first layer 634 may be applied in the cavity and in the anchoring cavities 622-1 and 622-2. After full or partial curing, a second layer 636 may be applied on top of the first layer 634.

The first layer 634 may comprise resin, resin and pigment (such as white pigment), resin and photoluminescent particles, or resin and any other material. The second layer 636 may comprise resin and photoluminescent particles. When a single layer is applied as in FIG. 17, the photoluminescent particles may tend to fall to a lowest point due to their heavier specific gravity. As a result, the photoluminescent particles may end up concentrating in the anchoring cavities 622-1 and 622-2, which can be seen when viewing the paving brick from the top. Furthermore, some of the resin described herein are relatively optically clear after curing and do not tend to show boundaries between cured layers. Therefore, when two or more layers are used and first layer does not include photoluminescent material, the anchoring cavities are less longer visible from the top of the paving brick.

As can be appreciated, the anchoring cavities 622 may be made parallel to each other. Alternately, additional anchoring portions may be used and may be arranged at different angles to increase strength.

In some implementations, the substrate is formed of plastic using any suitable process. For example, thermoforming, injection molding, CNC machining or any other suitable approach may be used. Additionally, post forming steps such as CNC milling can be used to trim edges and/or to form anchoring cavities. Alternately, these anchoring structures can be formed during manufacturing.

Figure 19:
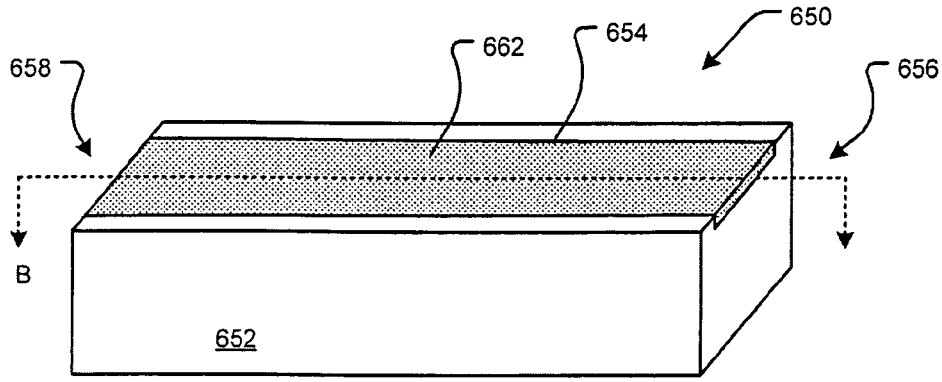
FIG. 19 illustrates another exemplary photoluminescent paving brick or other a substrate with a channel formed from one end to an opposite end thereof and photoluminescent portion in the cavity.

Referring now to FIG. 19, another exemplary photoluminescent paving brick 650 includes a substrate 652. The substrate 652 may be a conventional paving brick. A channel 654 is created from one end 656 to an opposite end 658 of the substrate 652. The channel can be created during manufacturing of the paving brick or cut after the paving brick is manufactured.

A photoluminescent portion 662 is molded, cast or formed in the channel or pre-formed, molded or cast and adhered in the channel with adhesive as described above. The photoluminescent portion 662 may comprise one or more layers as described herein.

As can be appreciated, the cavities described above may be formed in the paving brick during manufacturing of the paving brick. Alternately, the cavities described herein can be routed or drilled in the paving brick after manufacturing the paving brick. A more simple approach may be to use the channel 654. For example, the channel 654 may be created using a router bit that cuts from one end to the other rather than a plunge cutting method used to form a central cavity. The plunge cutting methods may tend to be more time consuming and expensive.

Figure 20:
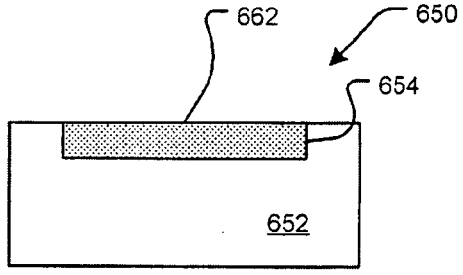
FIG. 20 is an end view of the exemplary photoluminescent device of FIG. 19.
Figure 21:
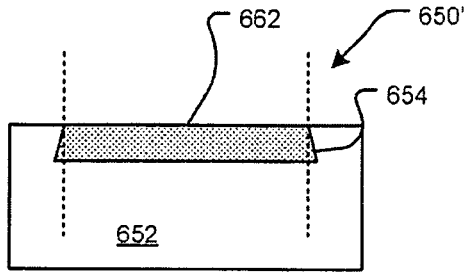
FIG. 21 is an alternate end view of the exemplary photoluminescent device of FIG. 19.

Referring now to FIGS. 20 and 21, exemplary end views of the exemplary photoluminescent paving brick of FIG. 19 are shown. The channel can have a rectangular or square end view. Alternately, the channel can have a trapezoidal cross section or other cross section with an undercut region to more securely hold the photoluminescent portion therein.

What is claimed is:

1. A non-powered photoluminescent paving brick, comprising:

a substrate defining one of a cavity and a channel that extends from one end to an opposite end of said substrate;

a photoluminescent portion comprising a light transmissive resin including a suspension of photoluminescent particles; and friction-enhancing particles suspended in said photoluminescent portion wherein said photoluminescent portion is arranged in said one of said cavity and said channel, wherein said light transmissive resin has an exposed outer surface that directly receives light, and wherein said photoluminescent portion comprises a plurality of stacked resin layers and wherein said friction-enhancing particles are suspended in one of said plurality of stacked resin layers.

2. The non-powered photoluminescent paving brick of claim 1 wherein said photoluminescent portion has a first thickness, wherein said friction-enhancing particles have a cross-sectional dimension that is greater than said first thickness and wherein at least part of said friction-enhancing particles project outwardly from an outer surface of said photoluminescent portion.

3. A non-powered photoluminescent paving brick, comprising:

a substrate defining one of a cavity and a channel that extends from one end to an opposite end of said substrate; and a photoluminescent portion comprising a light transmissive resin including a suspension of photoluminescent particles, wherein said photoluminescent portion is arranged in said one of said cavity and said channel, wherein said light transmissive resin has an exposed outer surface that directly receives light, and wherein said light transmissive resin has a shrinkage factor that is less than 0.1%.

4. The non-powered photoluminescent paving brick of claim 3 wherein said photoluminescent portion has a thickness that is greater than about 1/16" and less than about 1/2".

5. The non-powered photoluminescent paving brick of claim 3 wherein said photoluminescent particles have a size between 2 and 200 microns.

6. The non-powered photoluminescent paving brick of claim 3 wherein said light transmissive resin is substantially solvent-free.

7. A non-powered photoluminescent paving brick, comprising:

a substrate defining one of a cavity and a channel that extends from one end to an opposite end of said substrate; and a photoluminescent portion comprising a light transmissive resin including a suspension of photoluminescent particles, wherein said photoluminescent portion is arranged in said one of said cavity and said channel, wherein said light transmissive resin has an exposed outer surface that directly receives light, and wherein said light transmissive resin has tensile and compressive strengths that are greater than about 1000 psi.

8. The non-powered photoluminescent paving brick of claim 7 wherein said photoluminescent particles absorb ultraviolet light and re-emit visible light.

9. The non-powered photoluminescent paving brick of claim 7 further comprising a reflective layer arranged between an inner surface of said photoluminescent portion and said cavity, wherein said reflective layer comprises resin and at least one of pigment and reflective particles suspended therein.

10. A non-powered photoluminescent paving brick, comprising:

a substrate defining one of a cavity and a channel that extends from one end to an opposite end of said substrate;

a photoluminescent portion comprising a light transmissive resin including a suspension of photoluminescent particles, wherein said photoluminescent portion is arranged in said one of said cavity and said channel, and wherein said light transmissive resin has an exposed outer surface that directly receives light; and a reflective layer arranged between an inner surface of said photoluminescent portion and said cavity, wherein said reflective layer comprises resin and at least one of pigment and reflective particles suspended therein, and wherein said photoluminescent portion and said reflective layer have a combined thickness that is greater than or equal to about 1/16" and less than or equal to about 1/2".

11. The non-powered photoluminescent paving brick of claim 10 wherein said channel has one of a rectangular, square or trapezoidal cross section perpendicular to a direction of said channel.

12. The non-powered photoluminescent paving brick of claim 10 wherein said photoluminescent portion and said reflective layer each have a thickness of about 1/8".

13. A non-powered photoluminescent paving brick, comprising:

a substrate defining one of a cavity and a channel that extends from one end to an opposite end of said substrate;

a photoluminescent portion comprising a light transmissive resin including a suspension of photoluminescent particles, wherein said photoluminescent portion is arranged in said one of said cavity and said channel, and wherein said light transmissive resin has an exposed outer surface that directly receives light; and a reflective layer arranged between an inner surface of said photoluminescent portion and said cavity, wherein said reflective layer comprises resin and at least one of pigment and reflective particles suspended therein, and wherein said resin in said reflective layer and said photoluminescent portion forms a substantially seamless bond during curing.

14. The non-powered photoluminescent paving brick of claim 13 wherein said light transmissive resin has a viscosity that is less than 1000 centipoise.

15. The non-powered photoluminescent paving brick of claim 13 wherein said photoluminescent portion has a thickness that is greater than about 1/16" and less than about 1/2".

16. The non-powered photoluminescent paving brick of claim 13 wherein said photoluminescent particles have a size between 2 and 200 microns.

17. The non-powered photoluminescent paving brick of claim 13 wherein said light transmissive resin has a shrinkage factor that is less than 0.1%.

18. The non-powered photoluminescent paving brick of claim 13 wherein said light transmissive resin is substantially solvent-free.

19. The non-powered photoluminescent paving brick of claim 13 wherein said light transmissive resin has tensile and compressive strengths that are greater than about 1000 psi.

20. A non-powered photoluminescent paving brick comprising:

a substrate for said non-powered photoluminescent paving brick that includes plastic;

a photoluminescent portion comprising a light transmissive resin including a suspension of photoluminescent particles formed on one surface of said substrate; and anchoring cavities formed in said substrate, wherein said photoluminescent portion includes:

a first layer of said light transmissive resin that forms anchoring portions that extend from one side of said first layer into said cavities, wherein an opposite side of said first layer is substantially planar; and a second layer formed on said opposite side of said first layer and comprising said light transmissive resin and said suspension of photoluminescent particles.

* * * * *